US008651220B2

(12) United States Patent
Connor et al.

(10) Patent No.: US 8,651,220 B2
(45) Date of Patent: Feb. 18, 2014

(54) MULTI-DIRECTIONALLY ADJUSTABLE CONTROL PODS

(75) Inventors: Alan Robert Connor, Raleigh, NC (US); Richard Adam Kenneth Heald, Huncote (GB); Robert Michael Bower, Raleigh, NC (US); Paul Anthony Sheehan, England (GB)

(73) Assignee: Caterpillar Paving Products Inc., Minneapolis, MN (US)

( * ) Notice: Subject to any disclaimer, the term of this patent is extended or adjusted under 35 U.S.C. 154(b) by 313 days.

(21) Appl. No.: 13/248,642

(22) Filed: Sep. 29, 2011

(65) Prior Publication Data

US 2013/0081504 A1 Apr. 4, 2013

(51) Int. Cl.
*B60K 26/00* (2006.01)

(52) U.S. Cl.
USPC ..... 180/334; 180/326

(58) Field of Classification Search
USPC ..... 180/322, 324, 326, 334
See application file for complete search history.

(56) References Cited

U.S. PATENT DOCUMENTS

| | | | | |
|---|---|---|---|---|
| 3,893,346 | A * | 7/1975 | Paul | 74/471 R |
| 4,140,200 | A | 2/1979 | Tucet | |
| 4,646,869 | A | 3/1987 | Kerner, Jr. | |
| 5,553,992 | A | 9/1996 | Ashcroft | |
| 6,971,194 | B2 * | 12/2005 | McClelland et al. | 37/347 |
| 7,290,635 | B2 * | 11/2007 | Bisick et al. | 180/272 |
| 7,681,687 | B2 * | 3/2010 | Stander | 180/334 |
| 7,878,288 | B2 * | 2/2011 | Kostak et al. | 180/331 |
| 2004/0077464 | A1 * | 4/2004 | Feldman et al. | 482/57 |
| 2004/0261300 | A1 | 12/2004 | McClelland et al. | |

FOREIGN PATENT DOCUMENTS

| | | |
|---|---|---|
| EP | 0658458 | 6/1995 |
| JP | 8339233 | 12/1996 |
| JP | 2000148270 | 5/2000 |
| JP | 2002021119 | 1/2002 |
| JP | 2005248580 | 9/2005 |

* cited by examiner

*Primary Examiner* — Drew Brown
(74) *Attorney, Agent, or Firm* — Miller, Matthias & Hull

(57) ABSTRACT

A position-adjustable, dual-pod control system for a machine, such as a backhoe loader is disclosed. The system includes a horizontal cross beam connected to a pair of brackets. The pair of brackets are mounted to the machine by way of a pair of bearings that enables pivotal movement of the cross beam in the fore and aft directions while the cross beam is positioned perpendicularly to the fore and aft direction or the fore-aft centerline of the machine. The bottom end of each pod arm is pivotally coupled to the brackets thereby enabling the pod arms to be pivoted towards or away from the centerline. Each bracket includes a through hole that accommodates a bearing that is mounted to the machine, such as to the floor of the machine.

20 Claims, 8 Drawing Sheets

MULTI-DIRECTIONALLY ADJUSTABLE CONTROL PODS

TECHNICAL FIELD

This disclosure relates generally to an implement control system for a machine, such as a backhoe loader, that is adjustable in at least two directions for the comfort and ease of use of operators of varying heights, weights and body shapes.

BACKGROUND

Many machines have been developed for excavating. One commercially available type of machine often used for excavating is a backhoe loader. Generally, a backhoe loader includes a backhoe mounted on a tractor or other machine body that is moveable along the ground on wheels or tracks. The backhoe may be the only excavating implement on the tractor or machine body, or it may be one of a plurality of implements. For example, a backhoe loader may include a backhoe mounted at one end of a tractor and a loader bucket mounted at the other end of the tractor. Stabilizing legs may also be included to hold the tractor in place while the operator is digging with the backhoe.

A typical backhoe loader may include a boom coupled to the tractor, a stick coupled to the boom, a backhoe (or bucket) coupled to the stick and various hydraulic components and linkages for controlling the movement and position of the backhoe. In general, the boom may be pivotally mounted to the machine for movement in a generally vertical plane (this can also pivot left and right with respect to the tractor); the stick may be pivotally mounted to the boom for movement generally vertical with respect to the boom; and the backhoe may be pivotally mounted to the stick. The boom and/or the stick may be a fixed length element or it may be of the extendable, telescoping type. Each of the boom, stick, and bucket may be moved about various pivotal connections by one or more actuators, such as hydraulic cylinders. Further, the entire excavating assemblage of boom, stick, and backhoe may be mounted on the machine body that functions as a turret for swinging movement in a generally horizontal plane relative to the machine body.

Since the excavating assemblage of a backhoe loader is typically mounted at the rear of the tractor, the operator faces the rear of the machine during an excavating operation. Controls for the moving and positioning the backhoe and stabilizer legs may be located convenient to the rear-facing direction, while controls for the front loader bucket, steering, engine throttle, and brake may be located convenient to the front-facing direction.

Modern backhoe loaders typically employ a joystick-based control system for the various implements that control the movement and position of the backhoe, including the hydraulics that control movements of the backhoe, boom, stick and stabilizer legs. In fact, many backhoe loaders include dual control pods, each with a joystick disposed on top of a vertically oriented arms that are spaced apart on either side of the operator's seat.

Throughout the life of a backhoe loader, operators of different sizes and shapes will operate the implement controls. These operators of various sizes and shapes require multiple seating positions during a typical work cycle, depending upon where the work is being performed relative to the eye point of the operator. Conversely, many operators must use a variety of backhoe loaders, each with different interior dimensions and different placements of the implement control pods. As a result, consistently comfortable and ergonomic operating positions for each operator for all operating situations is difficult to provide. Further, because an operator must use both right hand and left hand control pods and because the control pods are sensitive, the comfort and ergonomics of the operator's position can directly affect both productivity and safety.

Accordingly, there is a need for backhoe control pods that are more fully adjustable than the control pods that are currently available. Such an improvement may increase the productivity of operators that use a variety of backhoe loaders and/or that feel a need to adjust the positions of the control pods or the operator seat multiple times during a work operation.

SUMMARY OF THE DISCLOSURE

A position-adjustable, dual-pod control system for a machine is disclosed. The machine includes a fore-aft centerline that extends between the front and rear of the machine. The disclosed system may include a horizontal cross beam, a pair of brackets, a pair of bearings and a pair of pod arms. The cross beam includes two opposing ends and is disposed at least substantially perpendicular to the fore-aft centerline. Each pod arm includes a top end and a bottom end. Each end of the cross beam may be coupled to one of the brackets. Each bracket may be pivotally coupled to the bottom end of one of the pod arms about parallel first axes that are both at least substantially parallel to the fore-aft centerline. As a result, the pod arms may pivot about the first axes that are at least substantially perpendicular to the fore-aft centerline. Further, each bracket and each bottom end of each pod arm may include coaxial through holes that accommodate one of the bearings. The pair of bearings may be coaxially aligned along a second axis that is at least substantially perpendicular to the fore-aft centerline thereby enabling cross beam, brackets and pod arms to pivot about the second axis and at least substantially parallel to the fore-aft centerline. Thus, both pod arms may be pivoted in directions both parallel and perpendicular to the fore-aft centerline.

A machine is also disclosed that includes a fore-aft centerline and a position-adjustable, dual-pod control system. The machine may include a floor, a horizontal cross beam, a pair of brackets, a pair of bearings, a pair of end plates and a pair of pod arms. The floor includes a top side and a bottom side. The cross beam may be disposed below the floor and has two opposing ends. The cross beam may also be disposed at least substantially perpendicular to the fore-aft centerline and is also coupled between the pair of brackets. Each pod arm may include a top and a bottom wherein the bottom of each pod arm is sandwiched between one of the brackets and one of the end plates. Each bracket may be pivotally coupled to the bottom end of its respective pod arm about parallel first axes that are at least substantially parallel to the fore-aft centerline and at least substantially parallel to each other thereby enabling the pod arms to pivot about the first axes and at least substantially perpendicular to the fore-aft centerline. Each bracket and each bottom end of each pod arm may also include coaxial through holes that accommodate one of the bearings. The pair of bearings are coaxially aligned along a second axis that is at least substantially perpendicular to the fore-aft centerline which enables the cross beam, brackets, end plates and pod arms to pivot about the second axis and at least substantially parallel to the four-aft centerline. The bearings may be disposed opposite the floor from the cross beam. In other words, the bearings may be disposed on top of the floor and the cross beam may be disposed beneath the floor.

Another machine is disclosed that also has a fore-aft centerline and a position-adjustable, dual-pod control system.

The machine may include a floor, a horizontal cross beam, a pair of brackets, a pair of bearings, a pair of end plates, a pair of pod arms, a swivel, a pair of linkages, a pair of pull cables, a pair of gas struts and a foot pedal assembly. The floor includes a top side and a bottom side. The cross beam may be disposed below the floor and substantially perpendicular to the fore-aft centerline. The cross beam may also be coupled between a pair of brackets. Each pod arm may include a top and a bottom wherein the bottom of each pod arm may be sandwiched between one of the brackets and one of the end plates. Each bracket may be pivotally coupled to the bottom end of its respective pod arm about parallel first axes that are at least substantially parallel to the fore-aft centerline which thereby enables the pod arms to pivot about the first axes and at least substantially perpendicular to the fore-aft centerline. Each bracket and each bottom end of each pod arm may also include coaxial through holes that accommodate one of the bearings. The pair of bearings may be coaxially aligned along a second axis that is at least substantially perpendicular to the fore-aft centerline. As a result, the cross beam, brackets, end plates and pod arms may pivot about the second axis and at least substantially parallel to the fore-aft centerline. The bearings may be disposed opposite the floor from the cross beam. The cross beam may be pivotally coupled to the swivel about a vertical axis. The swivel may include two ends. Each end of the swivel may be coupled to one of the linkages. The linkages may extend in opposite directions from the swivel and connect one end of the swivel to one of the end plates and the other end of the swivel to the other end plate. Each strut may include a releasable locking mechanism. One of the struts may be vertically aligned with one of the pod arms and coupled between said one of the pod arms and the floor. The other strut may be coupled between the swivel and the cross beam below the floor. Each releasable locking mechanism may be coupled to a pull cable and each pull cable is coupled to a bottom portion of the foot pedal assembly, which may be disposed below the floor but which also includes a top grip portion that is disposed above the floor. As a result, depressing the top portion of the foot pedal assembly pulls the pull cables which unlock both releasable locking mechanisms. Further, pivotal movement of the top end of one of the pod arms in a first direction that is perpendicular to the fore-aft centerline (either towards or away from the fore-aft centerline) may cause the bottom end of the pod arm to pull or push its respective linkage in an opposite second direction thereby causing the swivel to pivot about the vertical axis and push the other linkage in the first direction and pivot the top end of the other pod arm in the second opposite direction. Thus, the pod arms may be moved towards or away from each other. Further, pivotal movement of one of the pod arms in a third direction that is parallel to the fore-aft centerline may cause both pod arms and brackets to pivot parallel to the third direction and parallel to the fore-aft centerline.

DETAILED DESCRIPTION

Figure 1:
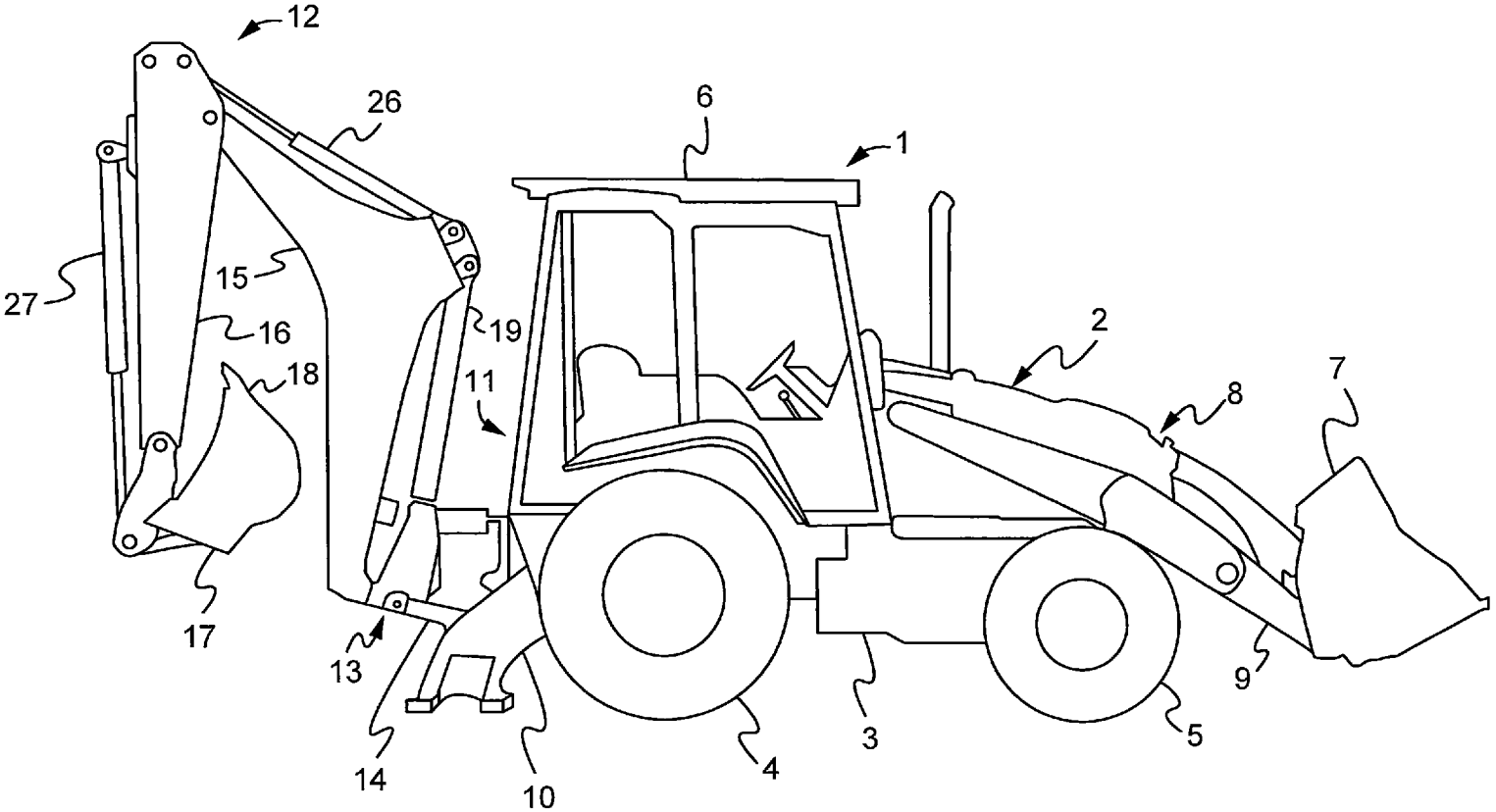
FIG. 1 is a side view of a backhoe loader that may be equipped with the adjustable control systems of this disclosure.
Figure 2:
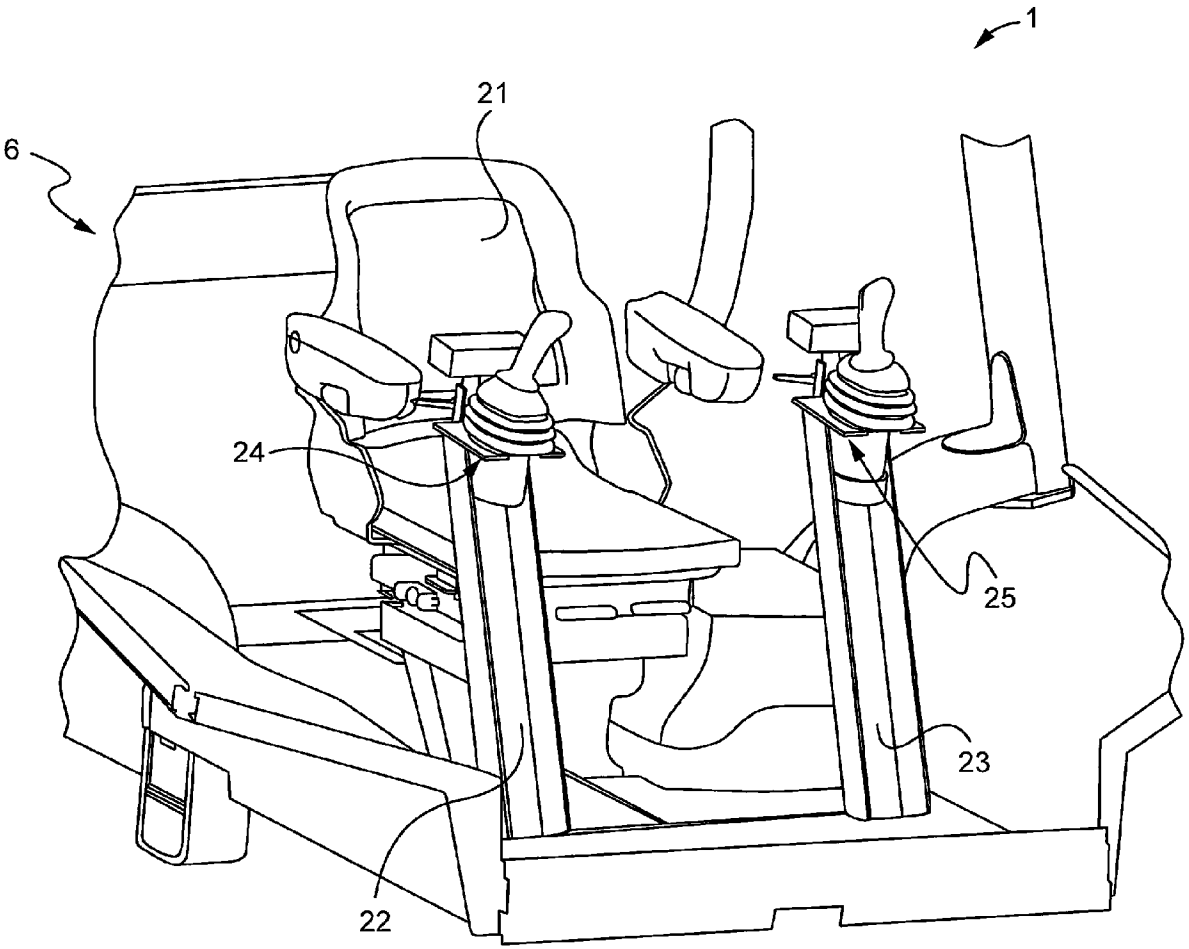
Fig. 2 (Prior Art)
FIG. 2 is a partial rear plan view of a backhoe loader cab showing the operator seat and conventional dual control pods disposed on either side of the operator seat.

FIG. 1 illustrates an exemplary backhoe loader 1 that may be employed in connection with embodiments of the disclosure. Backhoe loader 1 may include a machine, such as a tractor 2, having a chassis 3. The tractor 2 may include ground elements, such as a pair of rear wheels 4 and a pair of front wheels 5. It should be understood that, instead of wheels 4, 5, the tractor 2 could be provided with a pair of tracks or other structure to permit transportation of the tractor. Backhoe loader 1 may also include a cab 6 or other suitable facilities to accommodate an operator (not shown). The cab 6 may include suitable controls for controlling operation of the backhoe loader 1. For example, the controls may include joysticks 24, 25 as shown in FIG. 2 for enabling the operator to interface with the control system of the machine.

The backhoe loader 1 may include a loader bucket 7 at a first end 8 of the tractor 2, and suitable operating linkage 9 for manipulation of the loader bucket 7. The backhoe loader 1 may include a pair of outriggers or stabilizers 10, mounted adjacent a second end 11 of the tractor 2. The outriggers 10 may be hydraulically controlled in a relatively conventional manner to swing between a stored position, and an extended position in which they contact the ground.

The backhoe loader 1 may also include an excavating assemblage 12, for example, a backhoe mechanism, at the second end 11 of the tractor 2. The excavating assemblage 12 may include a suitable swing assembly 13 for permitting the backhoe mechanism to swing about a pivot from one side of the tractor 2 to the other. The swing assembly 13 may move under the control of one or more hydraulic cylinders, such as hydraulic cylinder 14, and may serve to move the excavating assemblage 12 from an excavating position to a dumping position.

The excavating assemblage 12 may include a boom 15 having a first end pivotally mounted adjacent the tractor 2 for movement in a generally vertical plane. A stick 16 may have a first end pivotally mounted adjacent the second end of the boom 15 for movement in the same generally vertical plane in which the boom 15 may move. An excavating implement, for example, in the form of a bucket 17, may be pivotally mounted at a second end of the stick 16 for pivotal movement in the same generally vertical plane in which the boom 15 and stick 16 may move. Bucket 17 may be a relatively conventional backhoe bucket with a heel portion 18. The boom 15 may be pivotally moved under the control of a hydraulic cylinder 19. The stick 16 may be pivotally moved under the control of a hydraulic cylinder 26. The bucket 17 may be pivotally moved under the control of a hydraulic cylinder 27.

Turning to FIG. 2, an operator station 20 is disclosed that includes a seat 21 disposed between a right control pod 22 and a left control pod 23. Both the control pods 22, 23 include right and left joysticks 24, 25 respectively. While the seat 21 is somewhat adjustable, additional adjustment capabilities for the control pods 22, 23 would provide numerous additional ergonomic and comfortable positions for the operator while he/she is controlling the backhoe implements with the joysticks 24, 25.

Figure 3:
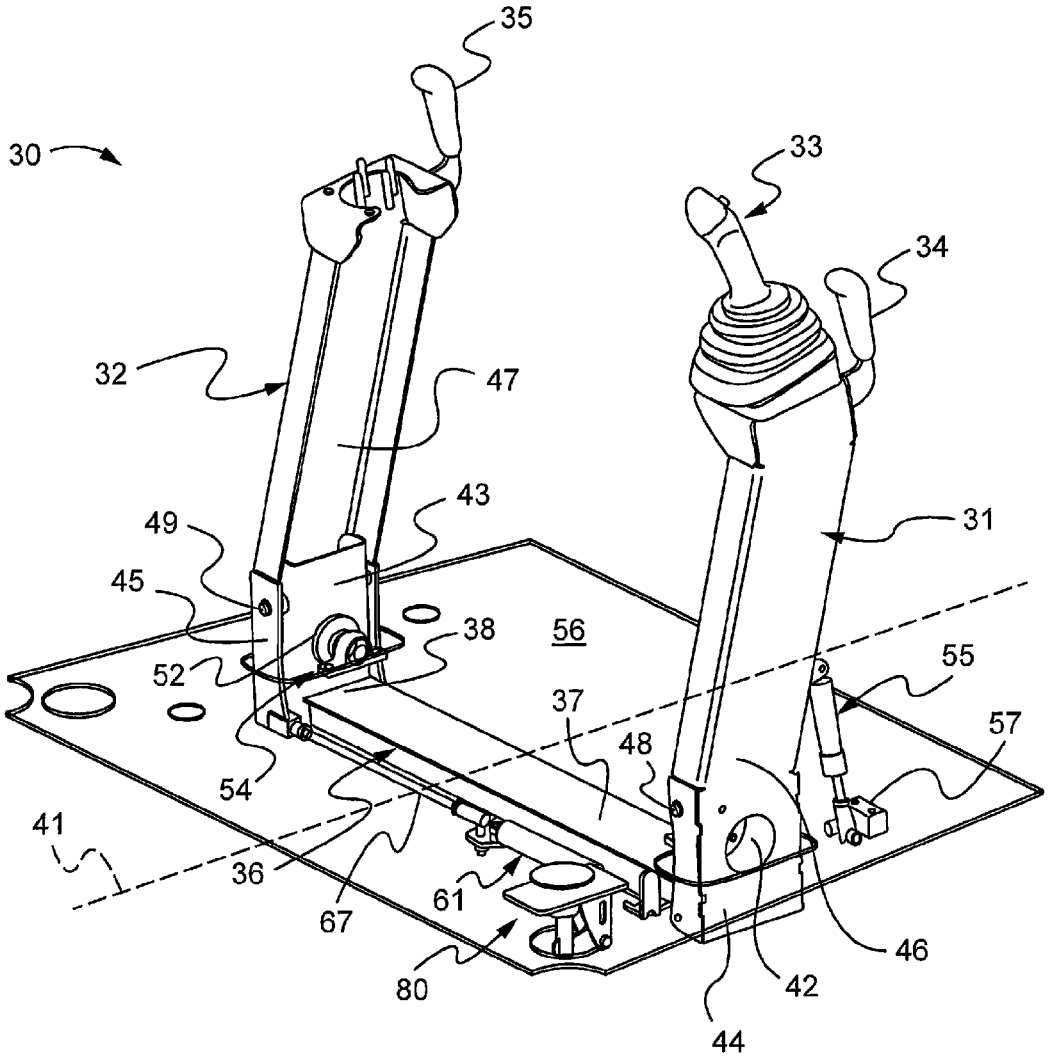
FIG. 3 is a perspective view of the disclosed multi-directionally adjustable control pods.

Turning to FIG. 3, a disclosed multi-directionally adjustable control pod system 30 is shown. The system 30 includes a right control pod arm 31, a left control pod arm 32, a right joystick 33 and a left joystick (not shown). The system 30 also includes a pair of handles or grips 34, 35 that may be used to control the position of the pod arms 31, 32 as explained in greater detail below.

Figure 4:
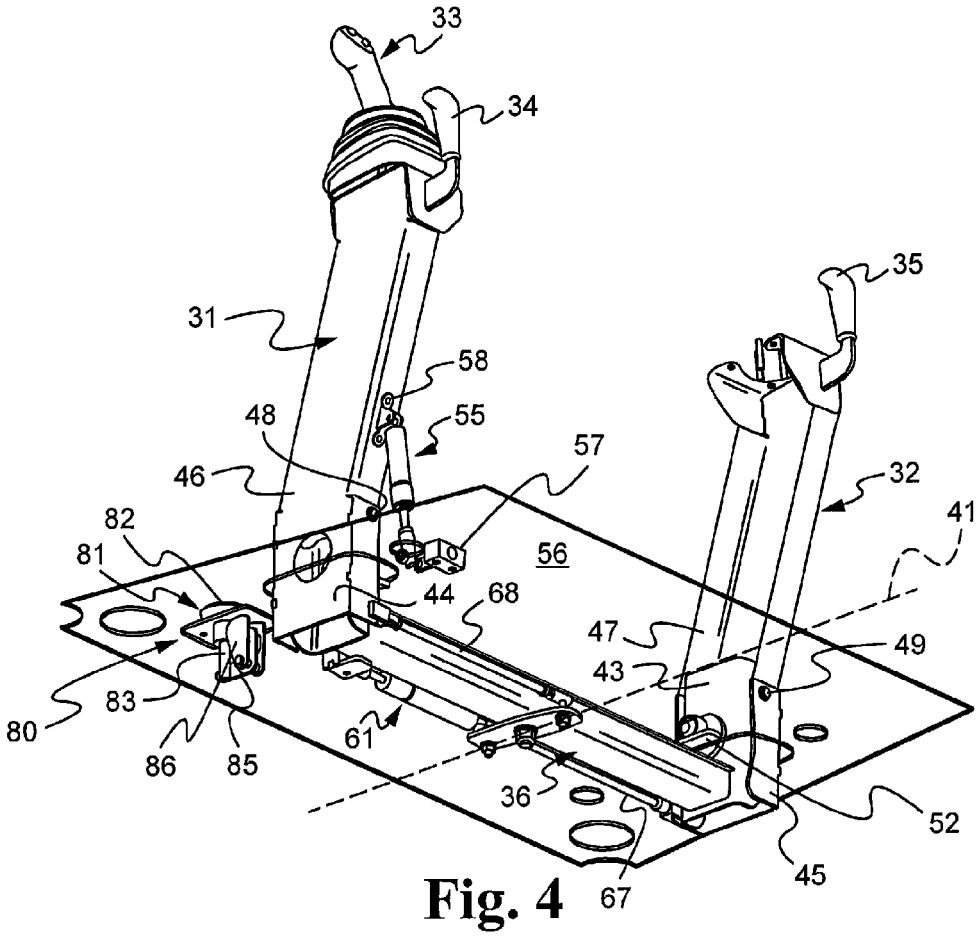
FIG. 4 is a bottom perspective view of the adjustable control pods illustrated in FIG. 3.

Still referring to FIG. 3, the system 30 includes a cross beam 36 that includes a right end 37 and a left end 38. The cross beam 36 may be oriented in a direction that is generally perpendicular to a fore-aft centerline 41 of the machine. Also shown in FIG. 2 are the brackets 42, 43 (see also FIGS. 4-5) disposed on either end 37, 38 of the cross beam 36 as well as the end plates 44, 45. The end plates 44, 45 may be pivotally connected to the bottom ends 46, 47 of the pod arms 31, 32 respectively about first axes that are at least substantially parallel to each other and at least substantially parallel to the fore-aft centerline 41 in which can be represented by the pins 48, 49 (see also FIGS. 4-5). The brackets 42, 43 may also be connected to the pod arms 31, 32 respectively by way of the pins 48, 49. However, because the brackets 42, 43 are also connected to the cross beam 36, the connection between the brackets 42, 43 and the pod arms 31, 32 is not a pivotal connection. Instead, referring to FIGS. 3-5, the brackets 42, 43 each include a through hole 51, 52, each of which accommodates a bearing 53, 54. The bearings 53, 54 enable the pod arms 31, 32, the brackets 42, 43, the end plates 44, 45 and the cross beam 36 to pivot in the fore and aft directions or at least substantially parallel to the fore-aft centerline 41.

To facilitate pivotal movement of the pod arms 31, 32 in the fore-aft directions, a gas strut 55 or other hydraulic device may be provided. The gas strut 55 is coupled to the floor 56 by a bracket 57 and may be coupled to the pod arm 31 by another bracket 58.

Figure 6:
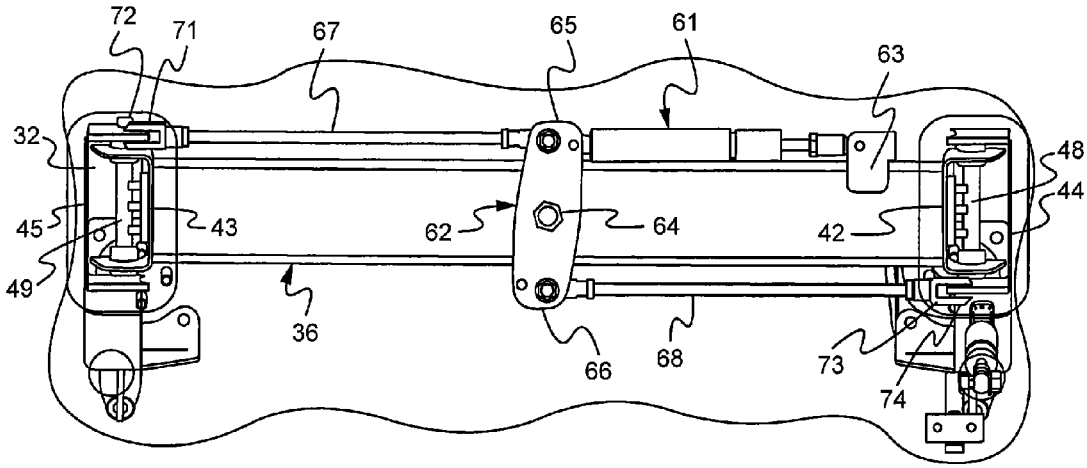
FIG. 6 is a bottom plan view of the adjustable control pods illustrated in FIGS. 3-5, particularly illustrating the swivel, linkages which connect the swivel to the end plates and the gas strut which facilitates pivoting movement of the swivel and linear movement of the linkages.

To facilitate pivotal movement of the pod arms 31, 32 towards or away from the fore-aft centerline 41, an additional gas cylinder 61 may be provided as illustrated in FIG. 6. The cylinder 61 may be connected to the swivel 62 at one end and to the cross beam 36 at its other end by way of the bracket 63. The gas cylinder 61 facilitates the pivotal movement of the swivel 62 about its vertical axis which can be represented by the fastener 64, which may be used to secure the swivel 62 to the cross beam 36. The swivel 62 may include two opposing ends 65, 66, which are connected to the linkages 67, 68. The linkage 67 connects the end 65 of the swivel 62 to the end plate 45, which is secured to the bottom 47 of the pod arm 32 by way of the clevis 71 and the pin fastener 72 as seen in FIG. 6. In contrast, the linkage 68 may be used to connect the end 66 of the swivel 62 to the other end plate 44 that is coupled to the bottom 46 of the pod arm 31. The linkage 68 is coupled to the bracket 42 by way of the clevis 73 and pin 74 as also shown in FIG. 6. Also shown in FIG. 6 are the pins 48, 49 that pivotally couple the end plates 44, 45 and bottom ends 46, 47 of the pod arms 31, 32 to the brackets 42, 43 respectively.

Figure 5:
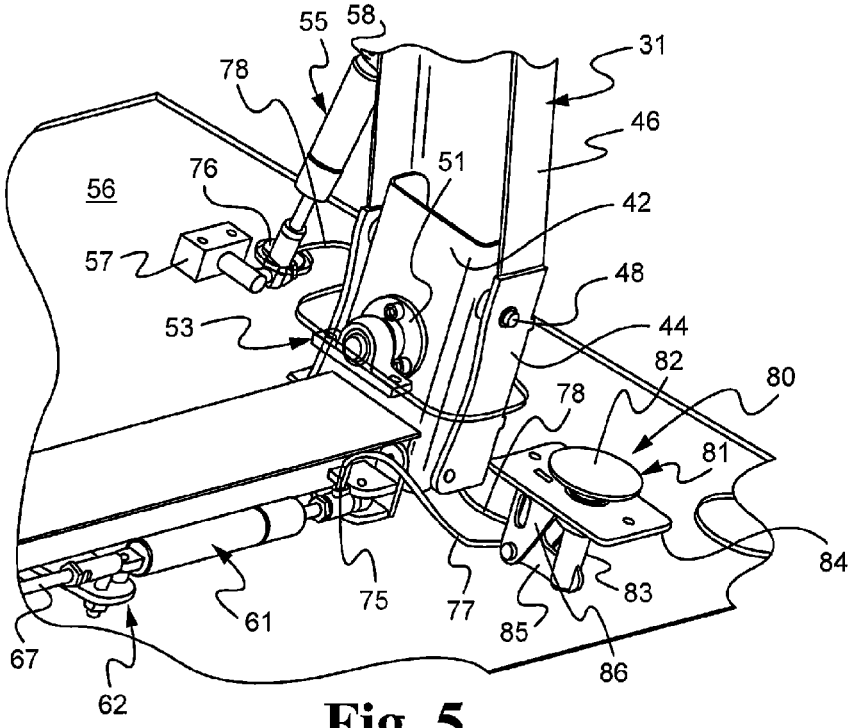
FIG. 5 is a partial view of the adjustable control pods illustrated in FIGS. 3 and 4, particularly illustrating the use of pull cables for unlocking the gas struts, which enables adjustment of the pod arm positions.

If utilized, the gas struts 55, 61 may be equipped with releasable locking mechanisms as shown at 75, 76 in FIG. 5 respectively. To unlock the locking mechanism 75, 76, pull cables 77, 78 are provided that couple the locking mechanism 75, 76 of the gas struts 61, 55 respectively to the foot pedal assembly 80. The foot pedal assembly 80 may include a foot pedal 81 that includes a grip portion 82 and a downwardly extending shaft 83 that extends through a supporting bracket 84 that is mounted to the floor 56. The shaft 83 may be coupled to a link 85 which, when the grip 82 is depressed, causes the fork 86 to pivot and pull on the pull cables 77, 78 thereby releasing the locking mechanisms 75, 76 of the gas struts 61, 55 respectively. Thus, an upper portion of the foot pedal assembly 80, which includes the grip 82, may be disposed above the floor 56 and the other components such as the shaft 83, bracket 84, link 85 and fork 86 may be disposed below the floor 56.

In operation, to adjust the positions of the pod arms 31, 32, the operator depresses the foot pedal 81 which causes the pull cables 77, 78 to be pulled, thereby releasing the locking mechanism 75, 76 of the gas cylinders 61, 55 respectively. To move the pod arms 31, 32 towards each other, the operator need only grip one of the handles 34, 35 and pull one of the pod arms 31, 32 inward towards the centerline 41 or push one of the pod arms 31, 32 outward away from the centerline 41. Inward movement of the pod arm 31 towards the centerline 41 will be matched by inward movement towards the centerline 41 of the other pod arm 32. To move the pod arms 31, 32 in the fore or aft directions, with the foot pedal 81 depressed and the locks 75, 76 released, the operator need only grip one of the handles 34, 35 and push or pull one of the pod arms 31 or 32 in the fore or aft directions. Forward or rearward movement of the one pod arm 31 will be matched by movement of the other pod arm 32 due to the connection of the two pod arms 31, 32 by way of the brackets 42, 43 and cross beam 36.

Figure 7:
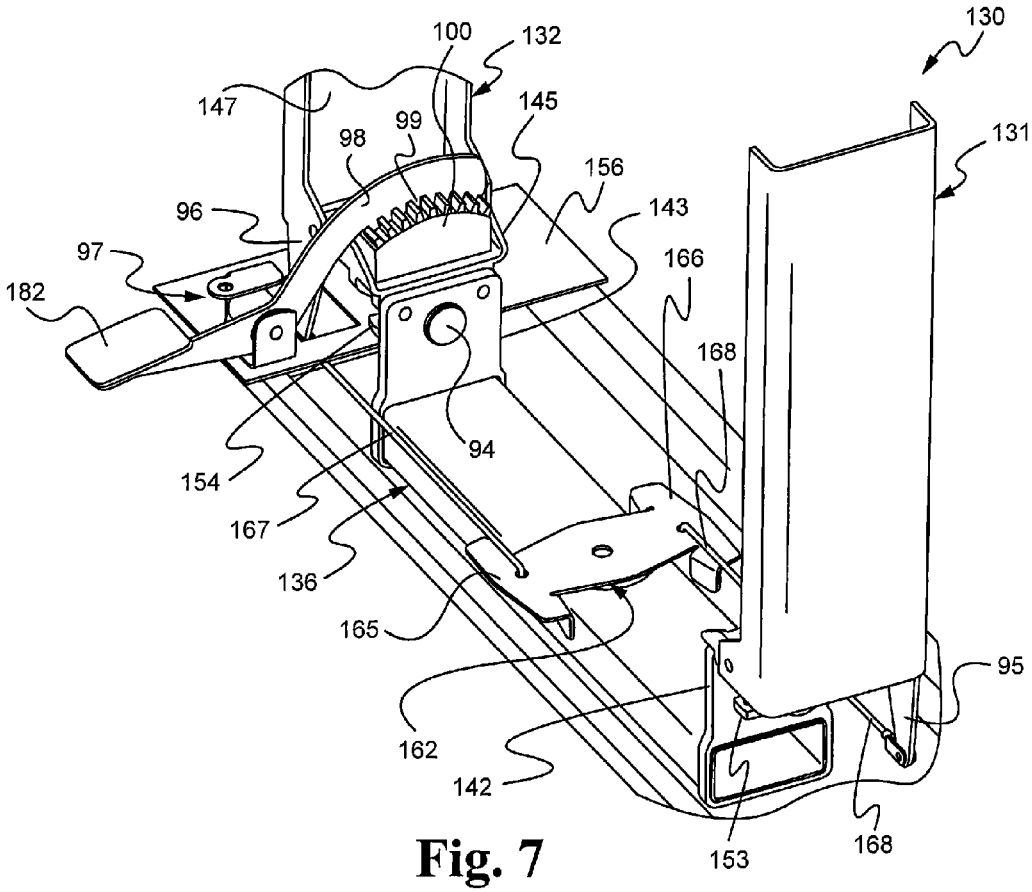
FIG. 7 is a partial perspective view of yet another disclosed adjustable control pod system.
Figure 8:
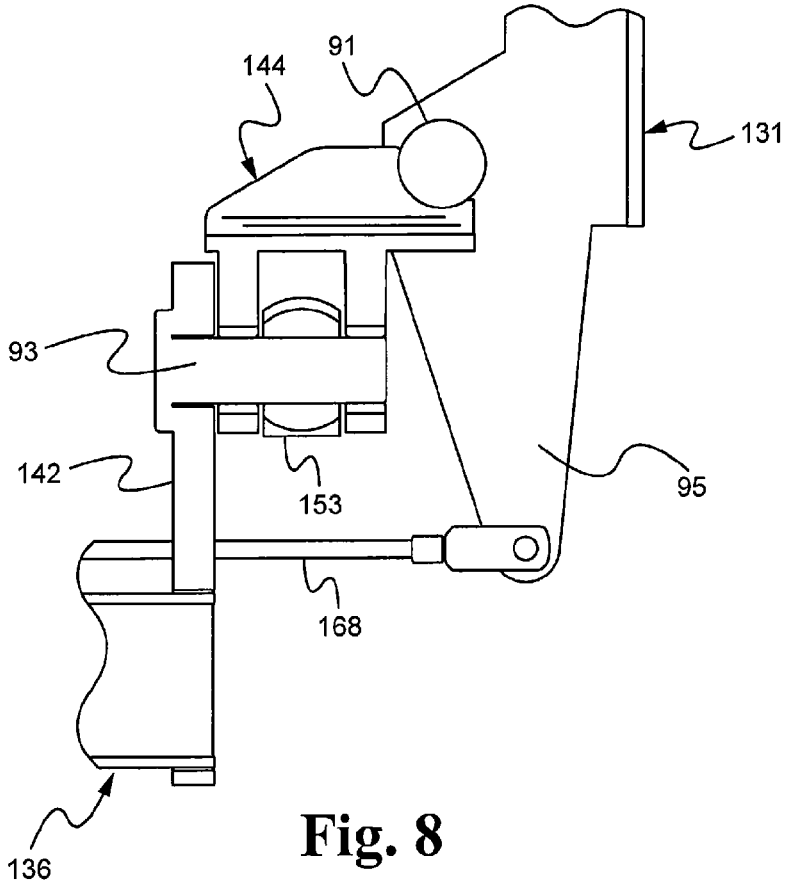
FIG. 8 is a partial view of the control pod system illustrated in FIG. 7, particularly illustrating the connection of the linkage to the control pod arm, and the pivots for inward/outward tilting and fore-aft tilting.
Figure 11:
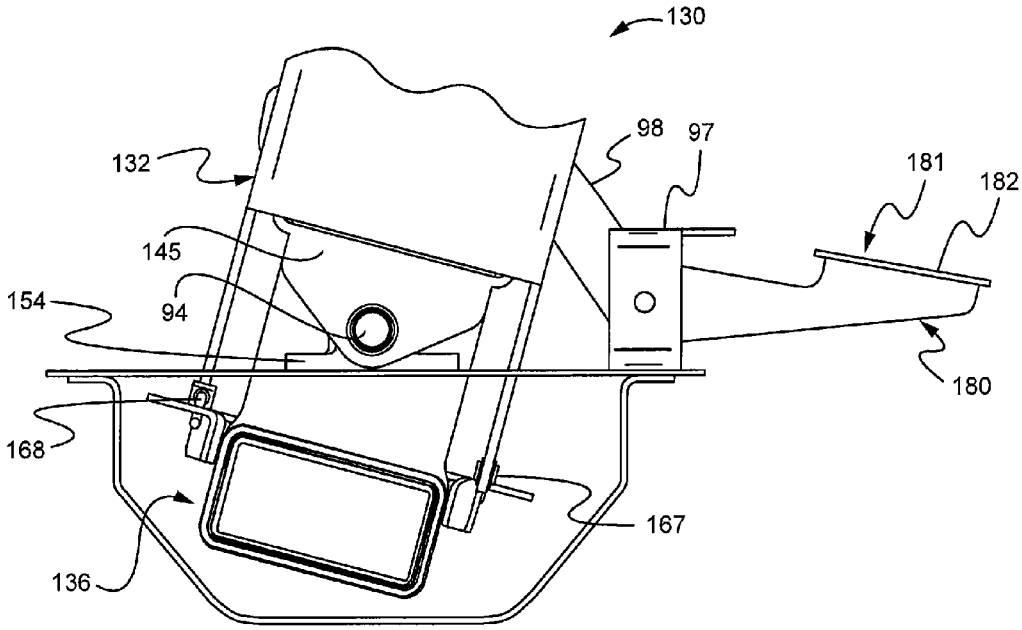
Figure 12:
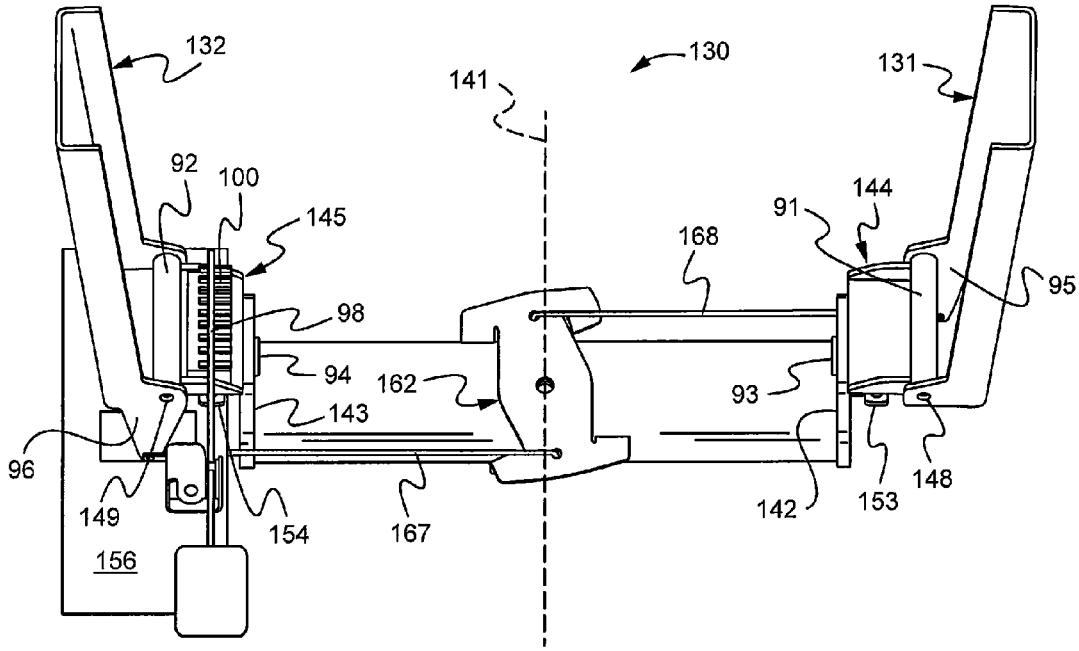
FIGS. 12-13 are top perspective views of the control pod system illustrated in FIGS. 7-11 with the pod arms disposed in a substantially vertical position (FIG. 12) and with the pod arms tilted towards each other and towards the fore-aft centerline (FIG. 13).

Turning to FIG. 7, an alternative embodiment is also disclosed. The pod system 130 also includes pod arms 131, 132 which are coupled to brackets 142, 143. The brackets 142, 143 may be coupled to the pod arms 131, 132 by fastening the bracket 142, 143 to the secondary brackets 144, 145 as best seen in FIGS. 11-12. Still referring to FIGS. 11-12, the secondary brackets 144, 145 are pivotally connected to the pod arms 131, 132 by pins 148, 149 that extend through the ferrules 91, 92. The cross beam 136, brackets 142, 143, secondary brackets 144, 145 and pod arms 131, 132 may be coupled to the floor 156 by shafts 93, 94 that pass through bearings (not shown) that may be supported by bearing housings 153, 154 (see FIGS. 6 and 11-12). The bearing housings 153, 154 may then be secured to the floor 156.

The system 130 of FIGS. 6-12 also includes a swivel 162 with two opposing ends 165, 166 that are coupled to linkages 167, 168. The linkages 167, 168 couple the swivel 162 to the pod arms 131, 132 at the downwardly extending tabs 95, 96. The system 130 also includes a foot pedal assembly 180 that includes a foot pedal 181 with a grip 182. The foot pedal assembly 180 is secured to the floor 156 by the bracket 97 which also serves as a pivot between the foot pedal 182 and the arm 98 that includes a gear sector 99 which, when locked, is enmeshed with the gear sector 100 that may be a part of the secondary bracket 145, or which may form part of the bottom 147 of the pod arm 132 as indicated in FIGS. 5 and 11-12.

Figure 13:
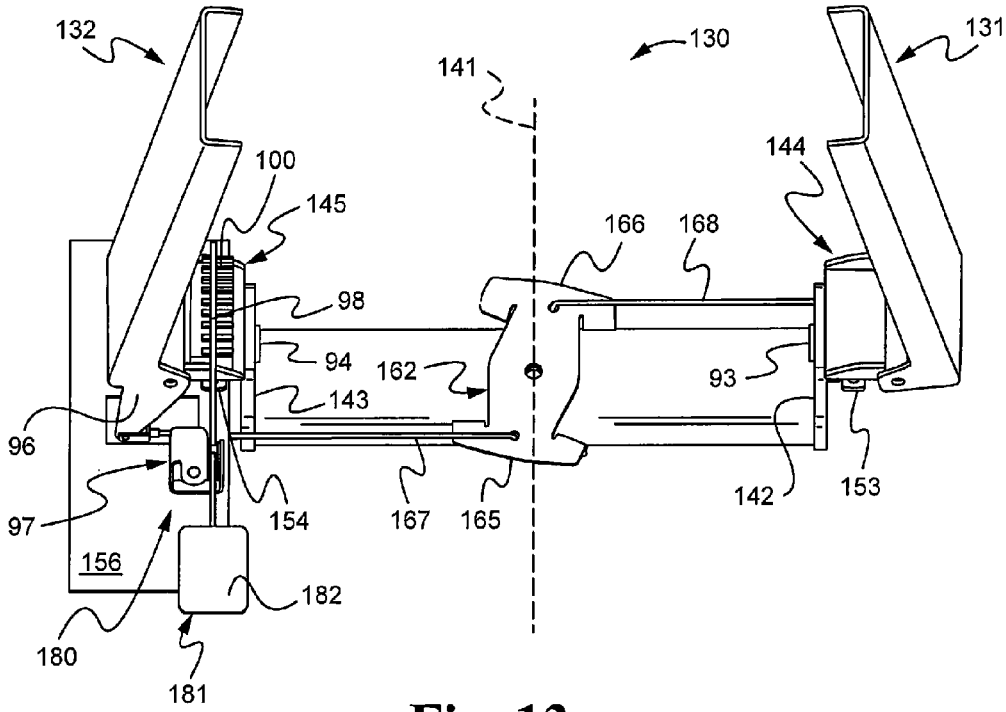

To operate the system 130, the foot pedal 181 is depressed thereby releasing the arm 98 from the gear sector 100. With the arm 98 released from the gear sector 100, the pod arms 131, 132 may be pushed either towards or away from each other. When pushed towards each other, the swivel 162 is twisted in the direction illustrated in FIG. 13 and the linkages 167, 168 move away from the centerline 141 as the pod arms 131, 132 move towards the centerline 141. Similarly, to increase the distance between the pod arms 131, 132, one of the pod arms is pushed outward as indicated in FIG. 12, which causes the linkages 167, 168 to move back towards the centerline 141 as the pod arms 131, 132 pivot away from the centerline 141.

Figure 9:
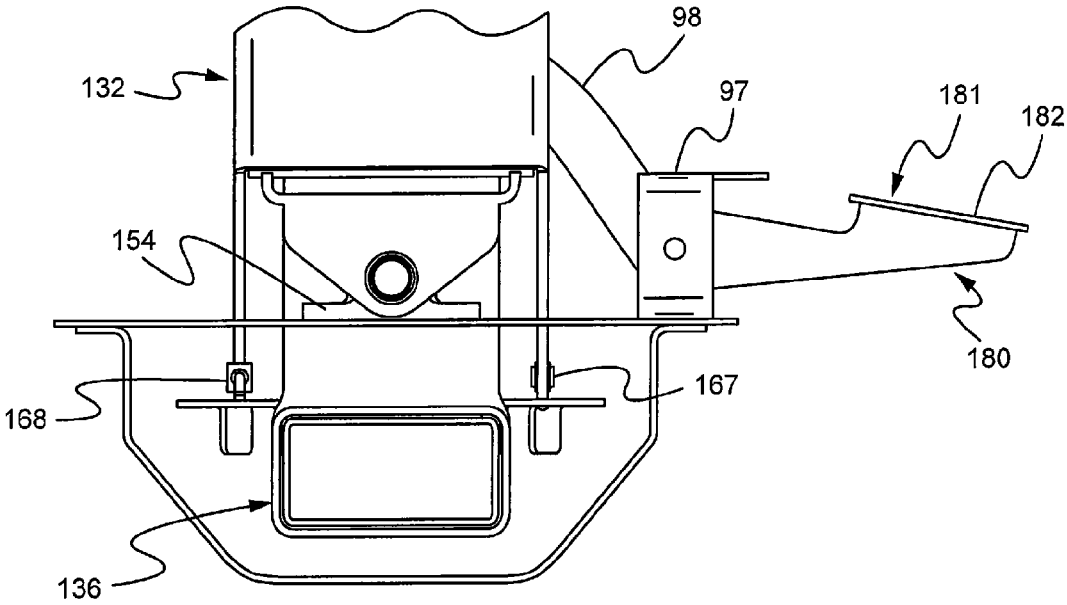
FIG. 9 is a partial end view of the control pod system illustrated in FIGS. 7-8, in an upright or vertical position.
Figure 10:
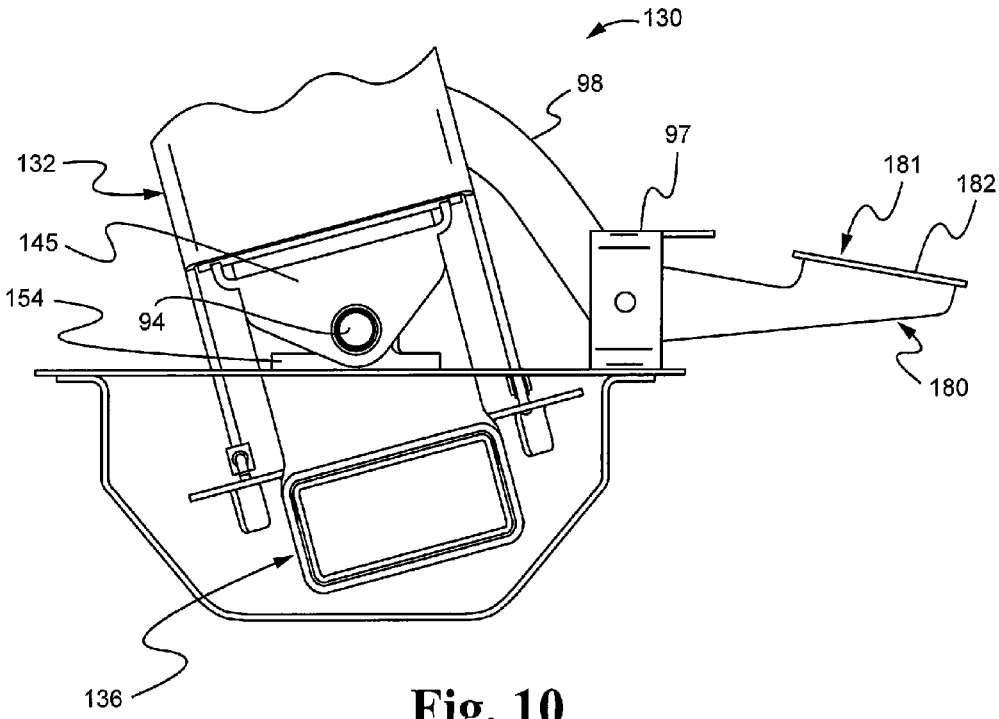
FIGS. 10 and 11 are additional partial end views of the control pod system illustrated in FIGS. 7-9, but tilting in fore and aft directions.

Turning to FIGS. 9-10, to move the pod arms 131, 132 in the fore or aft directions, one merely needs to release the arm 98 from the gear sector 100 and push one of the pod arms 131 or 132 in either the fore or aft directions thereby causing the arms 131, 132 to pivot about the shafts 93, 94 and bearings 153, 154.

Industrial Applicability

Thus, multi-directionally adjustable pod control systems 30, 130 are disclosed. The pod arms 31, 32, 131, 132 may be pivotally coupled to the floor 56, 156 or machine (not shown) in two different directions. Specifically, cross beams 36, 136 are used, which are connected to end brackets 42, 43, 142, 143. The end brackets are pivotally coupled to bearings 53, 54, 153, 154. Because the brackets 42, 43, 142, 143 are not pivotally coupled to the pod arms 31, 32, 131, 132, movement of either pod arm 31, 32, 131, 132 in the fore or aft directions or about an axis defined by the bearings 53, 54, 153, 154 moves both pod arms 31, 32, 131, 132 simultaneously. Further, to move the pod arms 31, 32, 131, 132 either towards or away from the fore-aft centerline 41, 141, the arms 31, 32, 131, 132 may simply be moved towards or away from each other by way of the pivotal connection about axes that are parallel to the centerline 41, 141 and that may be represented by the pins 48, 49, 148, 149 that pivotally couple the pod arms 31, 32, 131, 132 to the end brackets 44, 45 or secondary brackets 144, 145. Movement of either pod arm 31, 32, 131, 132 in either the fore or aft or laterally inward or laterally outward directions results in a like movement of the other pod arm 31, 32, 131, 132.

While the disclosed control system and method have been disclosed in connection with a typical backhoe loader, it should be understood that other types of excavating assemblages, such as a hydraulic excavator, for example, may benefit from employing the disclosed control system and method.

It will be apparent to those skilled in the art that various modifications and variations can be made to the disclosed control system and method without departing from the scope of the disclosure. Other embodiments will be apparent to those skilled in the art from consideration of the specification and practice of the disclosed embodiments. It is intended that the specification and examples be considered as exemplary only with the true scope of protection being indicated by the following claims.

What is claimed is:

1. A position-adjustable, dual-pod control system for a machine having a fore-aft centerline, the system comprising:

a horizontal cross beam, a pair of brackets, a pair of bearings and a pair of pod arms, the cross beam having two opposing ends and being disposed at least substantially perpendicular to the fore-aft centerline, each pod arm including a top end and a bottom end, each end of the cross beam coupled to one of the brackets, each bracket pivotally coupled to the bottom end of one of the pod arms about first axes that are at least substantially parallel to the fore-aft centerline thereby enabling the pod arms to pivot about the first axes and at least substantially perpendicular to the fore-aft centerline, each bracket accommodating one of the bearings, the pair of bearings being coaxially aligned along a second axis that is at least substantially perpendicular to the fore-aft centerline thereby enabling the cross beam, brackets and pod arms to pivot about the second axis and at least substantially parallel to the fore-aft centerline.

2. The control system of claim 1 further including a swivel and a pair of linkages, the cross beam being pivotally coupled to the swivel about a vertical axis, the swivel including two ends, each end of the swivel being coupled to one of the linkages, the linkages extending in opposite directions from the swivel to connect one end of the swivel to the bottom end of one of the pod arms and the other end of the swivel to the bottom end of the other pod arm, wherein pivotal movement of the top end of one of the pod arms towards the fore-aft centerline pulls its respective linkage away from the fore-aft centerline causing the swivel to pivot about the vertical axis and push the other linkage away from the fore-aft centerline and pivot the top end of the other pod arm towards the fore-aft centerline.

3. The system of claim 1 further including a releasable lock that prevents movement of either pod arm when the lock is engaged.

4. The system of claim 3 wherein the lock is disengaged by depressing a foot pedal.

5. The system of claim 1 further including a pair of expandable and contractible gas struts, each strut including a releasable locking mechanism, one of the struts being vertically aligned with one of the pod arms and coupled between said one of the pod arms and the machine, the other strut being coupled between the swivel and the cross beam, each releasable locking mechanism of each strut being coupled to a pull cable, each pull cable being coupled to a foot pedal, wherein depressing the foot pedal unlocks both releasable locking mechanisms.

6. The system of claim 1 further including a pair of end plates with one end plate coupled to the bottom end of each pod arm, each end plate being also pivotally coupled to one of the brackets along one of the first axes, and each linkage being coupled to one of the end plates.

7. The system of claim 1 wherein the top end of at least one of the pod arms is coupled to a joystick and a handle for adjusting the positions of the pods with respect to each other.

8. A machine having a fore-aft centerline and a position-adjustable, dual-pod control system, the machine comprising:

a floor, a horizontal cross beam, a pair of brackets, a pair of bearings, a pair of end plates and a pair of pod arms, the cross beam being disposed below the floor and having two opposing ends, the cross beam being disposed at least substantially perpendicular to the fore-aft centerline and being coupled between the pair of brackets, each pod arm including a top end and a bottom end, the bottom end of each pod arm being sandwiched between one of the brackets and one of the end plates, each bracket pivotally coupled to the bottom end its respective pod arm about first axes that are at least substantially parallel to the fore-aft centerline thereby enabling the pod arms to pivot about the first axes and at least substantially perpendicular to the fore-aft centerline, each bracket accommodating one of the bearings, the pair of bearings being coaxially aligned along a second axis that is at least substantially perpendicular to the fore-aft centerline thereby enabling the cross beam, brackets, end plates and pod arms to pivot about the second axis and at least substantially parallel to the fore-aft centerline, the bearings being disposed opposite the floor from the cross beam.

9. The machine of claim 8 further including a swivel and a pair of linkages, the cross beam being pivotally coupled to the swivel about a vertical axis, the swivel including two ends, each end of the swivel being coupled to one of the linkages, the linkages extending in opposite directions from the swivel to connect one end of the swivel to one of the end plates and the other end of the swivel to the other end plate, wherein pivotal movement of the top end of one of the pod arms towards the fore-aft centerline pulls its respective linkage away from the fore-aft centerline causing the swivel to pivot about the vertical axis and push the other linkage away from the fore-aft centerline and pivot the top end of the other pod arm towards the fore-aft centerline.

10. The machine of claim 8 further including a releasable lock that prevents movement of either pod arm when the lock is engaged.

11. The machine of claim 10 wherein the lock is disengaged by depressing a foot pedal.

12. The machine of claim 10 further including a pair of expandable and contractable gas struts and a foot pedal assembly, each strut including a releasable locking mechanism, one of the struts being vertically aligned with one of the pod arms and coupled between said one of the pod arms and the floor, the other strut being coupled between the swivel and the cross beam below the floor, each releasable locking mechanism of each strut being coupled to a pull cable, each pull cable being coupled to a bottom portion of the foot pedal assembly disposed below the floor, the foot pedal assembly also including a top grip portion disposed above the floor, wherein depressing the top portion of the foot pedal assembly unlocks both releasable locking mechanisms.

13. The machine of claim 8 wherein the top end of at least one of the pods arm is coupled to a joystick and a handle for adjusting the positions of the pods with respect to each other.

14. The machine of claim 8 further including a releasable lock that prevents movement of either pod arm when the lock is engaged.

15. The machine of claim 14 wherein the lock is disengaged by depressing a foot pedal.

16. The machine of claim 15 wherein the releasable lock includes two gear sectors that are enmeshed when locked and that disengage when the foot pedal is depressed.

17. The system of claim 1 further including a pair of expandable and contractable gas struts, each strut including a releasable locking mechanism, one of the struts being vertically aligned with one of the pod arms and coupled between said one of the pod arms and the floor, the other strut being coupled between the swivel and the cross beam, each releasable locking mechanism of each strut being coupled to a pull cable, each pull cable being coupled to an actuator, wherein depressing actuator unlocks both releasable locking mechanisms.

18. The machine of claim 17 wherein the actuator is a foot pedal.

19. A machine having a fore-aft centerline and a position-adjustable, dual-pod control system, the machine comprising:

a floor, a horizontal cross beam, a pair of brackets, a pair of bearings, a pair of end plates, a pair of pod arms, a swivel, a pair of linkages, a pair of pull cables, a pair of gas struts and a foot pedal assembly, the cross beam being disposed below the floor and having two opposing ends, the cross beam being disposed at least substantially perpendicular to the fore-aft centerline and being coupled between the pair of brackets, each pod arm including a top end and a bottom end, the bottom end of each pod arm being sandwiched between one of the brackets and one of the end plates, each bracket pivotally coupled to the bottom end its respective pod arm about first axes that are at least substantially parallel to the fore-aft centerline thereby enabling the pod arms to pivot about the first axes and at least substantially perpendicular to the fore-aft centerline, each bracket accommodating one of the bearings, the pair of bearings being coaxially aligned along a second axis that is at least substantially perpendicular to the fore-aft centerline thereby enabling the cross beam, brackets, end plates and pod arms to pivot about the second axis and at least substantially parallel to the fore-aft centerline, the bearings being disposed opposite the floor from the cross beam, the cross beam being pivotally coupled to the swivel about a vertical axis, the swivel including two ends, each end of the swivel being coupled to one of the linkages, the linkages extending in opposite directions from the swivel to connect one end of the swivel to one of the end plates and the other end of the swivel to the other end plate, each strut including a releasable locking mechanism, one of the struts being vertically aligned with one of the pod arms and coupled between said one of the pod arms and the floor, the other strut being coupled between the swivel and the cross beam below the floor, each releasable locking mechanism of each strut being coupled to a pull cable, each pull cable being coupled to a bottom portion of the foot pedal assembly disposed below the floor, the foot pedal assembly also including a top grip portion disposed above the floor, wherein depressing the top portion of the foot pedal assembly unlocks both releasable locking mechanisms and wherein pivotal movement of the top end of one of the pod arms in a first direction perpendicular to the fore-aft centerline causes the bottom end of the pod arm to pull or push its respective linkage in an opposite second direction causing the swivel to pivot about the vertical axis and push or pull the other linkage in the first direction and pivot the top end of the other pod arm in the second direction, and wherein pivotal movement of one of the pod arms in a third direction parallel to the fore-aft centerline causes both pod arms and brackets to pivot parallel to the third direction and parallel to the fore-aft centerline.

20. The machine of claim 19 wherein the top end of at least one of the pod arms is coupled to a joystick and a handle for adjusting the positions of the pods with respect to each other.

* * * * *